United States Patent [19]

Fuke et al.

[11] Patent Number: 4,830,304

[45] Date of Patent: May 16, 1989

[54] AUTOMATIC DEVICE FOR TREATING UNUSABLE PAPER USED IN DEVICE FOR PREPARING ROLLS FOR WEB PASTING

[75] Inventors: Masanobu Fuke; Takemi Watanabe, both of Osaka; Noriyuki Shiba, Tokyo, all of Japan

[73] Assignees: Kabushiki Kaisha Kaneda Kikai Seisakusho, Toyonaka; Kabushiki Kaisha Tokyo Kikai Seisakusho, Tokyo, both of Japan

[21] Appl. No.: 135,219

[22] Filed: Dec. 21, 1987

[30] Foreign Application Priority Data

Jan. 26, 1987 [JP] Japan ..... 62-15709

[51] Int. Cl.[4] ..... B65H 18/22; B30B 5/06

[52] U.S. Cl. ..... 242/67.2; 242/55.1; 242/DIG. 3; 100/152

[58] Field of Search ..... 242/DIG. 3, 67.2, 67.1 R, 242/55.1; 100/88, 151, 152

[56] References Cited

U.S. PATENT DOCUMENTS 3,691,942 9/1972 Wagley ..... 100/151
4,542,859 9/1985 Gerstenberger ..... 242/DIG. 3 X
4,573,644 3/1986 Brown ..... 242/67.1 R
4,583,697 4/1986 Bichot et al. ..... 242/DIG. 3 X
4,683,022 7/1987 Watanbe et al. .
4,685,392 8/1987 Watanbe et al. .

*Primary Examiner*—Stuart S. Levy
*Assistant Examiner*—Steven M. duBois
*Attorney, Agent, or Firm*—Griffin, Branigan & Butler

[57] ABSTRACT

The present invention relates to equipment used in a printing system for newsprint or the like, more specifically, to a device for successively rolling up unusable outer surface strips from paper rolls, compressing them, and then discharging them. The device comprises first and second conveyors which can be moved between a V-shaped position, wherein unusable paper is conveyed in a forward direction and rolled up into a cylindrical shape, and parallel positions, wherein the rolled-up, unusable paper is compressed flatly and discharged. A semi-arched guiding device disposed above the two conveyors cooperates with the conveyors to roll up the unusable paper into a cylindrical shape and one of the conveyors changes its conveying direction to switch from a rolling up mode to an ejection mode.

7 Claims, 4 Drawing Sheets

AUTOMATIC DEVICE FOR TREATING UNUSABLE PAPER USED IN DEVICE FOR PREPARING ROLLS FOR WEB PASTING

BACKGROUND OF THE INVENTION

The present invention relates to equipment used in a device for preparing paper rolls for web pasting which is an additional device for a rotary press or the like. More specifically, the invention relates to a device for continuously rolling up unusable paper, which is cut from a paper roll and discharged from the above-mentioned device for preparing paper rolls for web pasting, compressing the rolled-up unusable paper and externally discharging it.

As illustrated in FIG. 9, a general rotary press is continuously fed with paper by adhesively attaching the trailing end of an exhausting paper roll 57*a* being fed at a fixed rate to the leading end of a new paper roll 57*b* rotating at a rate peripherally equal to the rate at which the exhausting paper is being fed, using a pusher 58. Numeral 59 denotes a Y-shaped device for supporting paper rolls, and numeral 60 denotes a rotary drive device for the paper roll 57*b*.

To carry out automatic web pasting for the above-mentioned paper roll 57*b* the leading end of the paper roll 57*b* shall be prepared beforehand. As indicated in FIG. 10, the preparation of a leading end of a paper roll 57 comprises the following steps: removing damaged peripheral surface layers of the paper roll 57 (an unusable strip of paper approximately 5 to 30 m), cutting the leading web end into a V-shape, fixing the tip of the leading web end to the peripheral surface of the paper roll 57 using a tab 61 (end fastening strip), and forming a plurality of adhesive layers 62 onto the surface of the leading web end of paper roll 57 by means of double-sided adhesive tape.

Recently, the above preparation of a paper roll 57 for web pasting has been made by an automatic device for preparing paper rolls for web pasting, which is disclosed in Japanese Provisional Publication No. 61-12561 and U.S. Pat. Nos. 4,685,302 and 4,683,022.

The above-mentioned automatic device for preparing paper rolls for web pasting is installed at a position adjacent to a passageway of paper conveyance and designed to successively and automatically perform various processing steps in the following manner: cutting off the peripheral surface layers of the paper roll; drawing the leading web end onto a table board; forming a V-shaped incision and adhesive layers on the leading web end; separating the paper roll surface (unusable paper) along the incision; collecting the cut-off, unusable paper into a truck; adhesively attaching the V-shaped web to a base of a tab; and adhesively attaching the peripheral surface of the paper roll to a tip of the tab.

Conventionally, an automatic device for preparing paper rolls for web pasting drops unusable paper, which is cut from a paper roll (generally, surface layer of paper roll with a length of approximately 5 to 30 m) from the end of the table board using gravitational force only. This unusable paper is collected into a truck for collecting unusable paper.

The unusable paper is not always accurately fed into the truck and is frequently jammed during collection, resulting in an insufficient discharge of unusable paper. In addition, since unusable paper collected in the truck is disorderly and bulky, the truck is capable of collecting only small amounts of it and that which is collected is extremely difficult to treat as well.

In summary, conventional automatic devices for preparing paper rolls for web pasting involve the problem that post-treatment of unusable paper is quite difficult.

SUMMARY OF THE INVENTION

This invention has been developed with a view toward solving the above-mentioned problems that are generally associated with discharging the unusable paper, in relation to those devices described in Japanese Provisional Publication No. 61-12561 and U.S. Pat. Nos. 4,685,392 and 4,683,022.

The first object of the present invention is to provide a device for disposing unusable paper, whereby the unusable portion of paper rolls is smoothly and efficiently discharged.

The second object is to provide a device for disposing unusable paper, whereby the unusable portion of paper rolls is flatly compressed to facilitate collection.

The third object is to provide a device for disposing unusable paper, whereby a large amount of unusable paper can be collected in an orderly manner into a truck.

To accomplish the above objects, an automated device for treating unusable papers according to this invention is provided with the following components: first and second conveyors installed in a passageway for discharging unusable paper, which is cut from a paper roll, in a manner such that when viewed from the side, one conveyor is opposite the other; a conveyor supporting device which maintains the above-mentioned two conveyors in a V-shaped position, whereby the fed unusable paper is conveyed in a forward direction and rolled up into a cylindrical shape, and subsequently moves the two conveyors to a parallel position, wherein the rolled-up, unusable paper is compressed and discharged; and a semi-arched guiding device disposed above the two conveyors.

The automated device for treating unusable paper treats unusable paper cut off from a paper roll in the following manner:

(1) The first and second conveyors are secured to form a V shape and are rotated to convey in the same direction;

(2) The first conveyor receives the leading end of the unusable paper, which is separated from a paper roll and drawn from a table board, and the first and second conveyors then feed the end in a forward direction along a semi-arched guiding device. According to the above arrangement, the two conveyors continuously roll up unusable paper into a cylindrical shape;

(3) After an unusable paper of approximately 5 to 30 m is completely rolled up into a cylindrical shape, the positions of two conveyors shift so that they are substantially parallel to each other for flattening the cylindrically rolled-up, unusable paper. Then, the second conveyor reverses its rotating direction to discharge the rolled-up, flatly compressed, unusable paper from between the conveyors into a truck for collecting unusable papers, which is located under the conveyors; and, (4) After a specified amount of paper is collected in the truck, the truck is removed and replaced by an empty truck.

In practice, a device embodying the present invention exhibits the following advantages:

(1) Jamming of paper during operation is greatly reduced, since the first conveyor positively and accurately draws in unusable paper fed from the end of the table board;

(2) Bulkiness of rolled-up, unusable paper is greatly reduced, since the unusable paper is cylindrically rolled up and flatly compressed before being discharged;

(3) A large amount of unusable paper is conveyed at one time, since flatly-compressed, unusable paper is discharged in an orderly manner, facilitating collection of unusable paper into a truck for collecting unusable paper; and, (4) Unusable paper is automatically and smoothly discharged from a device for preparing paper rolls for web pasting, resulting in a reduction in the number of workers.

DETAILED DESCRIPTION OF THE INVENTION

Figure 1:
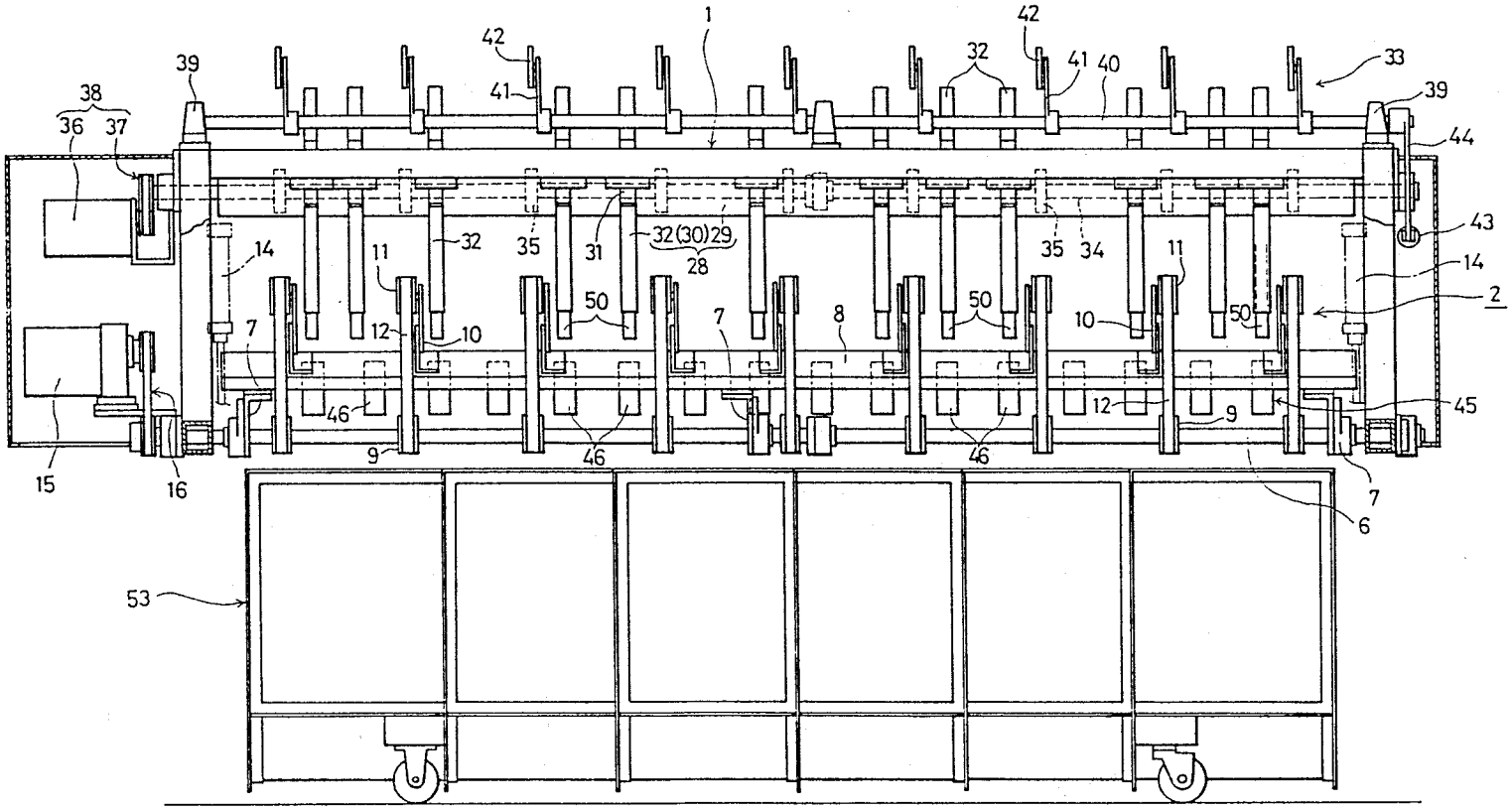
FIG. 1 schematically shows an elevationally-viewed, partial cutaway of a device of this invention for treating unusable paper.
Figure 3:
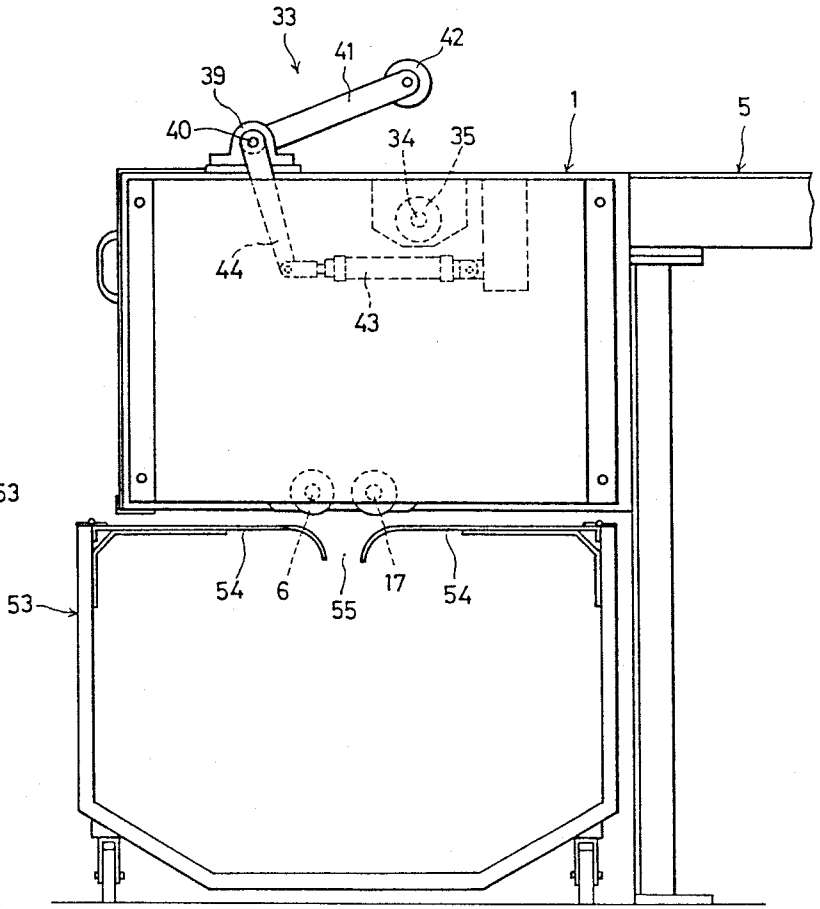
FIG. 3 is a lateral, rightside view of the unusable paper treating device of FIG. 1.
Figure 2:
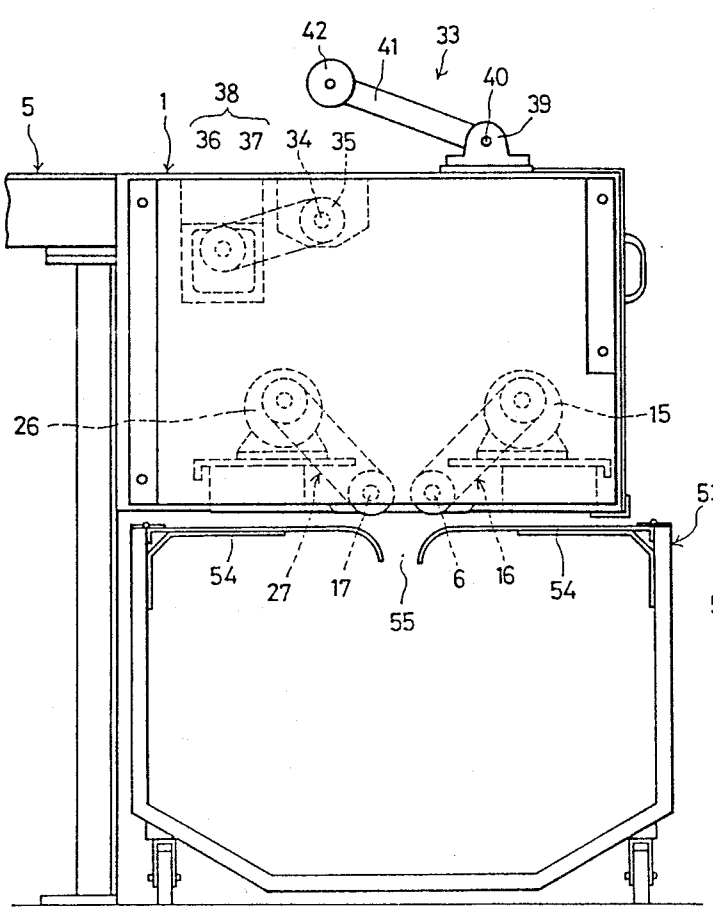
FIG. 2 is a lateral, leftside view of the unusable paper treating device of FIG. 1.

Referring now to the drawings, there is shown in detail a device embodying the present invention.

FIGS. 1 to 4 illustrate a device for treating unusable paper embodying the present invention. The device is installed at a position adjacent to the end of a table board included in an automatic device for preparing paper rolls for web pasting, which is disclosed in Japanese Provisional Publication No. 61-12661, etc., comprising a frame 1, first conveyor 2, second conveyor 3, first conveyor supporting device, second conveyor supporting device, various guiding devices, and others.

The above-mentioned frame 1 is constructed of square tubes and channel irons or the like, and is attached to a passageway for discharging unusable paper 4 which is cut from a paper roll; the passageway for discharging unusable paper 4 is formed at the end of a table board 5 of an automatic device for preparing paper rolls for web pasting.

The first conveyor 2 and second conveyor 3 are installed at the passageway for discharging unusable paper 4, and are designed to assume a V-shaped position for rolling up paper, whereby the unusable paper 4 is received and rolled up cylindrically, and virtually parallel positions for compressing and discharging rolled-up paper, whereby the rolled-up, unusable paper is compressed flatly and then discharged.

More specifically, the first conveyor 2 includes a first drive shaft 6 rotatably and horizontally mounted at the lower portion of frame 1 with bearings or the like; a plurality of first lower brackets 7 rotatably disposed at the first drive shaft 6 with bearings; a first support 8 composed of square tubes which are fastened to the first lower brackets, being parallel to the first drive shaft 6; a plurality of first drive pulleys 9 engaged with the first drive shaft 6 at proper intervals; a plurality of extendable and adjustable first upper brackets 10 disposed parallel at the first support 8 at proper intervals; a plurality of first driven pulleys 11 rotatably mounted at the first upper brackets 10 with bearings, assuming a position opposite to each corresponding first drive pulley 9; and, first flat belts 12 engaged with both pulleys 9 and pulleys 11.

The above-mentioned first conveyor 2 has nine first flat belts in total in accordance with the width of unusable paper 4. These belts are designed to travel in a specified direction.

In this embodiment for the present invention, the first belts 12 travels in a specific direction by means of a first geared motor 15 which is installed at the side of the frame 1 and a first drive apparatus 16 disposed between the output shaft of the first geared motor 15 and the first drive shaft 6.

In the above embodiment, conveyors are constituted by using flat belts 12, however, a means other than belts, such as chains, may be used for the present invention.

Figure 4:
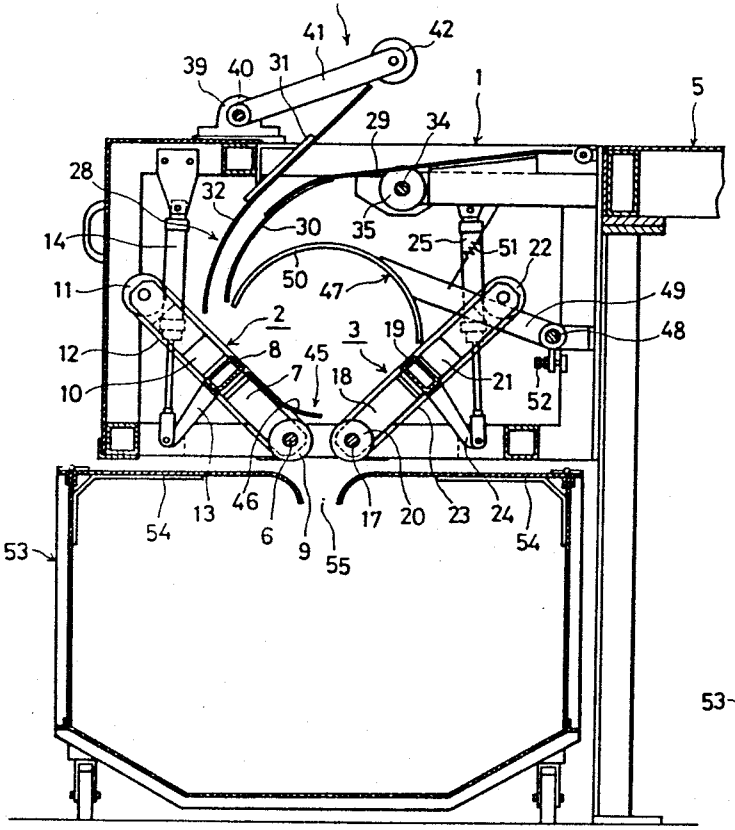
FIG. 4 schematically shows a sectional vertical, leftside view of the unusable paper treating device of FIG. 1.
Figure 9:
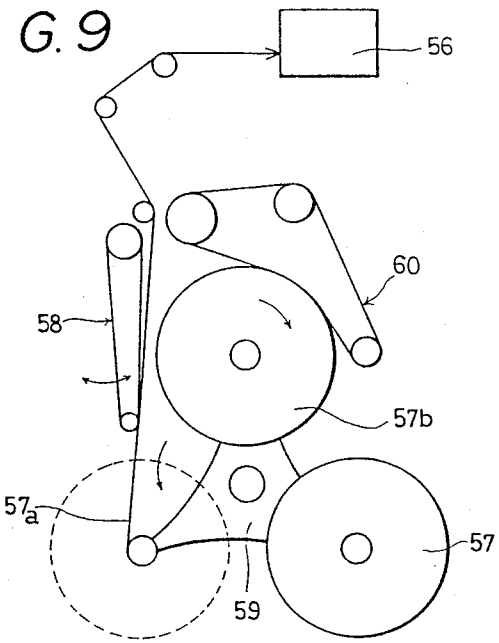
FIG. 9 schematically illustrates a paper supplying device in a rotary press; and, FIG. 10 is a perspective view of a paper roll prepared for web pasting.
Figure 10:
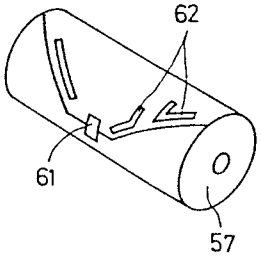

The above-mentioned first conveyor 2 is secured by a first conveyor supporting device comprising a first arm 13 and a first hydropneumatic cylinder 14, enabling the upper portion of the first conveyor 2 to swing in the right and left directions, as shown in FIG. 4, with the first drive shaft 6 functioning as an axis. The first conveyor 2 in this embodiment is allowed to move by disposing the first arm 13 and the first hydropneumatic cylinder 14 between the frame 1 and the first support 8, and by controlling the first hydropneumatic cylinder 14.

The second conveyor 3 is installed in a position opposite to the first conveyor 2 with a predetermined space therebetween.

The second conveyor 3 generally has the same structure as the first conveyor 2; more specifically, it comprises a second drive shaft 17; a second lower bracket 18; a second support 19, second drive pulleys 20; second upper brackets 21; second driven pulleys 22; second flat belts 23; etc.

The above-mentioned second conveyor 3 is secured by a second conveyor supporting device, whereby the upper portion of the conveyor is, as shown in FIG. 4, movable in the right and left directions, rotating on the second drive shaft 17. The second conveyor supporting device comprises a second arm 24 and a second hydropneumatic cylinder 25 disposed between the frame 1 and the second support 19.

The second flat belts 23 for the second conveyor 3, which can travel in a direction opposite to that of first flat belts 12 are operated by a second geared motor 26 laterally installed at the frame 1 and a second drive apparatus 27 disposed between the above-mentioned second geared motor 26 and the second drive shaft 17.

Figure 5:
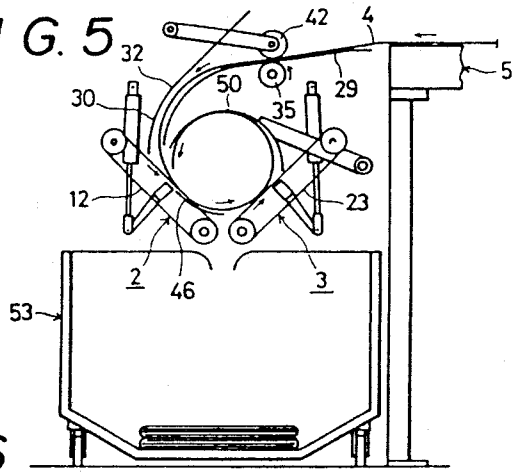
FIG. 5 schematically shows a side view of an operating, unusable paper treating device of this invention with unusable paper being fed from a table board.
Figure 7:
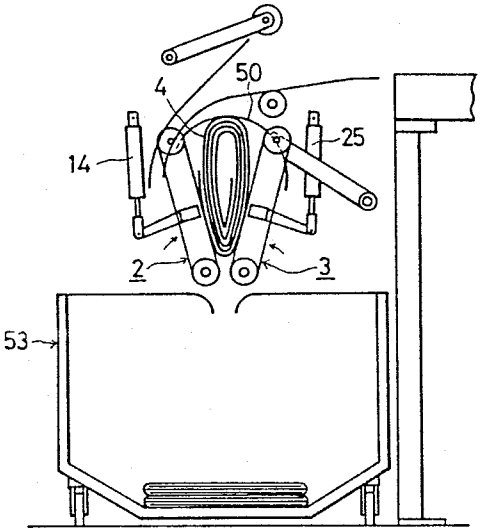
FIG. 7 is a schematic view similar to FIGS. 5 and 6 showing unusable paper being compressed.

Moving the two conveyors 2 and 3 by controlling the first and second hydropneumatic cylinders 14 and 25 enables the conveyors to assume a V-shaped rolling-up position (see FIG. 5) and parallel positions for compressing and discharging (see FIG. 7).

Although unillustrated in this embodiment, the two conveyors 2 and 3 are designed to be horizontally movable and adjustable in order to change the distance between each drive shaft 6 and 17, by using a position adjusting device (unillustrated). When the two conveyors 2 and 3 are changing their position, each geared motor 15 and 26 also moves synchronously with each drive shaft 6 and 17.

Also unillustrated in this embodiment, the two conveyors 2 and 3 are provided with supporting plates not only to prevent slackening each of flat belts 12 and 23, but also to properly and accurately compress unusable paper 4.

Guiding devices for the above-mentioned unusable paper include an entrance guide 28, a first guide 45, and a second guide 47.

The above-mentioned entrance guide 28 is located at the upper portion of frame 1, delivering unusable paper 4, discharged from the table board 5, to the first conveyor. The entrance guide 28 comprises a guide plate 29 fixed to the frame 1; a plurality of strip-configured lower plates 30 connected to the guide plate 29 at regular intervals; a plurality of upper guide plates 32 that are fixed to the frame 1 via brackets 31 and positioned above the upper part of the lower guide plates 30; and others. The guide plate 29 leads the unusable paper 4 to the first conveyor 2 via a clearance formed by the lower guide plates 30 and the upper guide plates 32. The lower guide plates 30 and upper guide plates 32 are so arranged that these plates do not collide with the moving first conveyor 2.

The above-mentioned first guide 45 is installed at the lower end of the first conveyor 2, and accurately leads the unusable paper 4 on the first flat belt 12 to the second flat belt 23. The first guide 45 comprises a plurality of extremely flexible guide plates 46 disposed alternately with the first flat belts 12. Each end of the guide plates 46 are attached to the support plate (unillustrated). The strength of the guide plates 46 is so determined as not to prevent the smooth feeding of unusable paper 4 upon compressing and feeding it downwardly.

The second guide 47 is located above the two conveyors 2 and 3, smoothly leading the unusable paper 4 on the second flat belt 23 to the first flat belt 12 and rolling up cylindrically the unusable paper. The second guide 47 includes a plurality of support arms 49 attached to a shaft 48, which is rotatably supported by the frame 1 at regular intervals, and a semi-arched guide plate 50 attached to each support arm 49 and disposed above the two conveyors 2 and 3. Each of the above-mentioned support arms 49 are secured by a tension spring 51 installed between the support arm 49 and the frame 1, while an adjusting bolt 52, disposed at the base of the support arm 49, controls downward rotary movement of the support arm 49. Moreover, the semi-arched guide plates 50 are so arranged that the plates do not collide with the second conveyor 3 upon position change of the conveyor in this embodiment, being installed in the same imaginary vertical planes as the upper and lower guide plates 32 and 30.

An unusable paper feeding device 33, which feeds unusable paper 4 on the guide plate 29 to the first conveyor 2, is disposed above the entrance guide 28. The unusable paper feeding device 33 includes a drive shaft 34 horizontally and rotatably disposed at the frame 1 at the lower portion of the guide plate 29; drive rollers 35 attached to the drive shaft 34 at regular intervals with their external surfaces slightly protruding above the guide plate 29; a drive apparatus 38 for rotating the drive shaft 34, comprising a motor 36 installed at the side of the frame 1 and a drive linkage 37; a shaft 40 secured to the frame 1 via a bearing 39; a plurality of movable arms 41 attached to the shaft 40 at regular intervals; driven rollers 42 which are fastened to the movable arms 41 by means of bearings, enabling contact with the drive rollers 35; a hydropneumatic cylinder 43 disposed between the frame 1 and the drive shaft 34, whereby the driven rollers 42 are allowed to alter their positions between two configurations, that is, contacting or not contacting the driven roller 35; an arm 44; and, others.

The guide plate 29 is partially cut away for those portions corresponding to the positions of the driven rollers 35.

The above-mentioned unusable paper feeding device conveys unusable paper 4 forwardly to the first conveyor 2, using the rotary feeding force of the drive rollers 35 contacting the driven rollers 42 with the unusable paper 4 being sandwiched between the two rollers 35 and 42.

Under the above-mentioned first and second conveyors 2 and 3, a truck 53 for collecting unusable paper is disposed to store the discharged unusable paper 4. Both ends of the truck for collecting unusable paper 53 are open and the truck has a pair of removable cover plates 54 at the top. A clearance 55 to accommodate compressed unusable paper 4 is formed between the pair of removable cover plates 54.

Operation of the above-mentioned automatic device for disposing unusable papers is described below.

After unusable paper 4 is cut and separated from a paper roll and discharged from the table board 5 of the automatic device for preparing paper rolls for web pasting, the unusable paper feeding device 33 operates to feed the unusable paper 4 to the first conveyor 2 via the clearance between the lower and upper guide plates 32 and 30 of the guide 28.

The unusable paper 4 which has reached the first conveyor 2 is transported diagonally downwards by the first flat belts 12 and accurately delivered to the second conveyor 3 via the guide plate 46 of the first guide 45.

Subsequently, the unusable paper 4 fed to the second conveyor 3 is carried diagonally upwards by the second flat belts 23 and returned onto the first flat belts 12 guided by the semi-arched guide plate 50 of the second guide 47.

Figure 6:
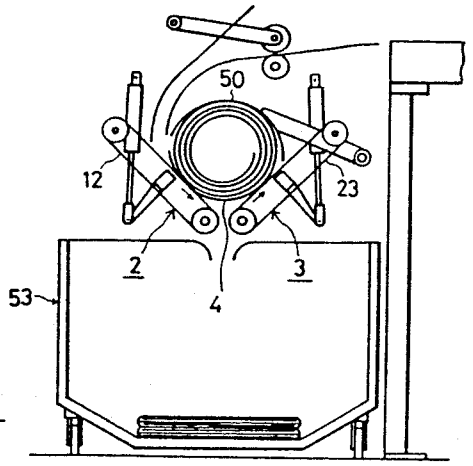
FIG. 6 is a schematic view similar to FIG. 5 showing unusable paper being rolled up.

Thus, as shown in FIG. 6, unusable paper 4 is successively rolled up by operation of the two conveyors 2 and 3, and the two guides 45 and 47. During the rolling-up operation, the two conveyors are in the rolling-up position, forming a V shape.

After the unusable paper 4 is completely rolled up into a cylindrical shape, the two flat belts 12 and 23 stop operation, and the first and second hydropneumatic cylinders 14 and 25, included in the first and second supporting devices, are subsequently activated to move the two conveyors in directions as indicated by the arrows in the FIG. 7 embodiment. As a result, the two conveyors 2 and 3 compress the unusable paper 4 flatly.

Figure 8:
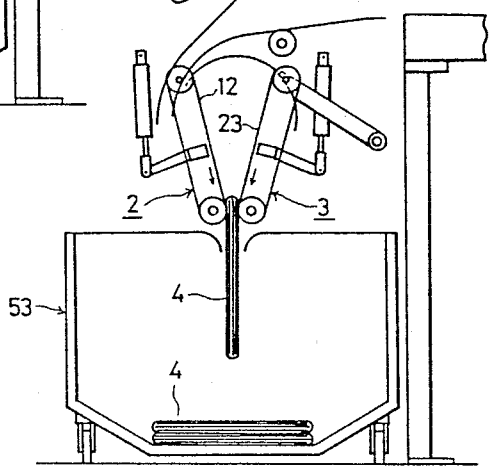
FIG. 8 is a schematic side view similar to those of FIGS. 5, 6, and 7 showing flatly compressed unusable paper being discharged into a truck for disposing unusable paper.

After the unusable paper 4 is compressed flatly, the second flat belts 23 reverse their traveling direction while the first flat belt travels normally in order to shift the paper feeding direction downwardly, as shown in FIG. 8, and to discharge the unusable paper 4 into the truck for collecting unusable paper 53.

According to the above-mentioned steps, the unusable paper discharged from the table board 5 is successively treated.

The structure of the above-mentioned two conveyors 2 and 3 is not limited to those described in the embodiment, and any type of device may be used as far as the device can receive, cylindrically roll up, flatly compress, and discharge the unusable paper 4.

In addition, structures of various devices, including the first conveyor, the second conveyor, the entrance guide 28, the first guide 45 and the second guide 47, are not limited to those described in the embodiment, and any type of device may be used as far as the device can accurately deliver unusable paper 4 to a predetermined location.

Furthermore, structures of the unusable paper feeding device are not limited to those described in the embodiment.

The embodiments of the invention in which an exclusive property and privilege are claimed are defined as follows:

1. A device for disposing unusable paper to be used on a device for preparing rolls for web pasting which comprises:

first and second conveyors positioned in a discharge passageway for unusable paper cut from a paper roll with the first and second conveyors being placed, when viewed from the side, in an opposed relationship;

conveyor supporting devices which support the first and second conveyors in such a manner that the first and second conveyors can be placed in a v-shaped arrangement for advancing unusable paper in a first conveying direction and simultaneously rolling up the same in a cylindrical shape, said conveyor supporting devices including arm means connected to said first and second conveyors for pivoting said first and second conveyors relative to one another toward a parallel relationship thereby compressing the rolled-up unusable paper in a flattened shape and discharging it; and semi-arched plates disposed over the first and second conveyors for guiding usable paper from the second conveyor to the first conveyor.

2. A device as claimed in claim 1, wherein the first and second conveyors are belt conveyor apparatus.

3. A device as claimed in claim 1, wherein said conveyor supporting devices further include a means for adjusting the distance between the first and second conveyors when the first and second conveyors are positioned substantially parallel to each other.

4. A device as claimed in claim 1, wherein an entrance guide is provided at a location upstream of the first conveyor for leading unusable paper to said first and second conveyors.

5. A device as claimed in claim 1, wherein an unusable-paper feeding means is provided at a location upstream of the first conveyor for forcibly feeding unusable paper in the first conveyor.

6. A device a claimed in claim 1, wherein a guide comprising plates is disposed between the first and second conveyors for ensuring delivery of unusable paper from the first conveyor to the second conveyor.

7. A device as claimed in claim 3, wherein the conveying direction of the second conveyor is reversible so that, after the rolled-up unusable paper is compressed by the first and second conveyors being positioned substantially parallel to each other, the second conveyor may reverse its conveying direction to a second, opposite, conveying direction, while the first conveyor keeps conveying in said first conveying direction, for discharging the compressed unusable paper.

* * * * *